United States Patent [19]

Sudoh et al.

[11] Patent Number: 4,545,227

[45] Date of Patent: Oct. 8, 1985

[54] APPARATUS FOR DRY TYPE CONTINUOUS WIRE DRAWING

[75] Inventors: Chuzoh Sudoh; Hyoji Hagita; Motoo Asakawa; Hiroshi Nagai; Kenji Aihara, all of Amagasaki, Japan

[73] Assignee: Sumitomo Metal Industries, Ltd., Osaka, Japan

[21] Appl. No.: 505,844

[22] Filed: Jun. 20, 1983

[30] Foreign Application Priority Data

Jun. 18, 1982 [JP] Japan ..... 57-105011

[51] Int. Cl.[4] ..... B21C 9/00; B21C 43/04; B21C 51/00

[52] U.S. Cl. ..... 72/12; 72/31; 72/40; 72/44

[58] Field of Search ..... 72/3, 4, 10, 11, 12, 72/31, 40, 42, 43, 44; 51/DIG. 10

[56] References Cited

U.S. PATENT DOCUMENTS

| | | | |
|---|---|---|---|
| 2,329,376 | 9/1943 | Illmer et al. | 72/40 |
| 2,703,550 | 3/1955 | Bell | 72/40 X |
| 3,145,832 | 8/1964 | Case | 72/43 |
| 3,373,584 | 3/1968 | Rundt et al. | 72/12 X |

FOREIGN PATENT DOCUMENTS

| | | | |
|---|---|---|---|
| 772915 | 10/1971 | Belgium | 72/40 |
| 2405806 | 8/1975 | Fed. Rep. of Germany | 72/10 |
| 2928731 | 2/1981 | Fed. Rep. of Germany | 72/11 |
| 2070644 | 9/1971 | France | 72/10 |
| 163047 | 12/1981 | Japan | 72/40 |
| 2038689 | 7/1980 | United Kingdom | 72/10 |

*Primary Examiner*—E. Michael Combs

*Attorney, Agent, or Firm*—Burns, Doane, Swecker & Mathis

[57] ABSTRACT

Herein disclosed are dry type continuous wire drawing process and machine which can enhance the productivity by conducting in-line a wire drawing operation including the steps of flaw detection and wire repair. The wire to be drawn is mechanically descaled and is then coated with a lubricant. The wire thus coated is drawn through a drawing die. At the coating step, the wire is first coated with lime powder and then with metallic soap. Thus, the wire is drawn under dry and continuous conditions. After the drawing operation, a flaw in surface of the wire is detected. The surface flaw is located from the running speed or distance of the wire and the detecting instant. The surface flaw located is removed. The resultant wire is wound up. The surface flaw which cannot be removed is marked. An internal defect in the drawn wire is also detected with ultrasonic waves. The internally detected portion is also marked. All of the steps thus far recited and others are conducted in-line.

6 Claims, 8 Drawing Figures

APPARATUS FOR DRY TYPE CONTINUOUS WIRE DRAWING

BACKGROUND OF THE INVENTION

1. Field of the Invention

The present invention relates to a dry type wire drawing machine for continuously drawing a wire rod or a steel bar (which will be shortly referred to as a "wire").

2. Description of the Prior Art

In a general example of a secondary working operation for a wire to be cold-forged into bolts or nuts, the wire is pickled so that it may be descaled. Next, the descaled wire is treated with a lubricant and is then subjected to a drawing operation. After that, the drawn wire is annealed to spheroidize so as to give a high cold-forgeability. The wire once drawn is pickled and treated with a lubricant at a second state and is then secondarily drawn by the so-called "skin pass".

In the prior art, the pickling treatment, the surfacing treatment for lubrication, and the lubricating treatment are conducted by the batch-type process, by which a coiled wire is hung by means of a C-shaped hook so that it may be consecutively immersed in and transferred to and from the respective treating liquid baths. As a result, the batch-type process suffers from problems: that the productivity is so low as to raise the cost; that an additional cost for disposing the respective treating liquids is high because the environmental pollution has to be considered; that satisfactory working circumstances are not always provided because the treatments are of the wet type; and that inspection of the product over the whole length is difficult.

Here, liquid zinc phosphate is used as lubrication surfacer of the prior art, and a liquid which is prepared by dissolving either powdered metallic soap or a mixture of lime and metallic soap is used as the lubricant. However, the cost for this process is high. Moreover, the wire to be cold-forged is subjected to the surfacing treatment with a lubricant, i.e., zinc phosphate having an excellent lubricity although this lubricant is expensive, because the lubricant used for the drawing treatment effects, as it is, the lubrication required for the cold-forging treatment.

For the more and more severe requirement for qualities in recent years, on the other hand, flaw detection and repair of the drawn wire become more and more important treatments. Generally speaking, however, the in-line flaw detection and the automatic wire repair are so remarkably difficult that they have been conducted exclusively off-line. Once the drawn wire has been taken up, more specifically, its flaw is either subjected, at a finishing step, to detection by the use of a nondestructive or destructive flaw detector or visually detected by human eyes if it is located in the surface. Then, the flawed portion is manually repaired by means of a grinder or the like. Despite this fact, the off-line method of the prior art is so inefficient and uneconomical that it is tremendously troublesome, that space for the facilities is additionally required, and the transporting works are complicated.

Upon elimination of the aforementioned surface flaw, on the other hand, it is being recently developed that the flawed surface portion is cut only a predetermined length all over the circumference, in view of the fact that the yield is reduced by the general example of the prior art because the wire is either peeled off its whole length over the whole circumference by means of a die or cut by means of a cutting tool on the same principle as that of a lathe. Despite this development, reduction in the yield cannot be avoided because the wire is cut all over the circumference even partially in the longitudinal direction.

We, the Inventors, have succeeded in completing the present invention by earnestly repeating the experiments and researches while aiming at, as has been described hereinbefore: a first target that the batch-type treating process should be replaced by the continuous drawing process because it has a problem in efficiency and so on; a second target that the dry type process is desired from the standpoint that the wet type process cannot provide satisfactory working circumstances but raises the cost for the facilities so that it is not acceptable; and a third target that the steps from the flaw detection to the repair are made in-line.

SUMMARY OF THE INVENTION

It is, therefore, an object of the present invention to provide dry type continuous wire drawing process and machine which are enabled to retain satisfactory working circumstances, while eliminating the problem of disposal of waste liquids, and to enhance the productivity to reduce the cost by continuously conducting the wire drawing treatment.

Another object of the present invention is to provide a dry type continuous wire drawing process and machine which conduct in-line the steps from flaw detection to repair.

According to a feature of the present invention, there is provided a dry type continuous wire drawing process comprising the step of running a wire to be drawn, which is rewound from a pay-off stand, on a line including: the step of mechanically descaling the wire being run; the step of coating the surface of said wire with a powdered lubrication surfacer; the step of coating the surfacer-coated wire with a powdered lubricant; the step of drawing the lubricant-coated wire through a drawing die; the step of detecting a flaw in the surface of the drawn wire; the step of locating the surface flaw from the running speed or distance of the drawn wire and the detecting instant of the surface flaw and removing the located surface flaw; and the step of winding up the drawn wire.

According to another feature of the present invention, there is provided a dry type continuous wire drawing machine comprising: a pay-off stand for supplying a wire to be drawn therefrom; mechanical descaling means for removing scale from said wire; lubricating surfacer treating means having an applying die for pressure-applying a powdered lubricating surfacer to the surface of said wire; pre-die dry type lubrication treating means; a drawing die for drawing the wire which has been subjected to the lubrication; a surface flaw detector for detecting the surface flaw state of the drawn wire; automatic repairing means for removing the flawed surface portion of said drawn wire; a control unit made responsive to a surface flaw state signal from said surface flaw detector for sending a repair signal to said automatic repairing means; and takeup means for taking up the repaired wire, wherein the components of said machine except said control unit are consecutively arranged in series.

BRIEF DESCRIPTION OF THE DRAWINGS

Other objects, features and advantages of the present invention will become more apparent from the following description taken in conjunction with the accompanying drawings, in which.

DESCRIPTION OF THE PREFERRED EMBODIMENTS

Figure 1:
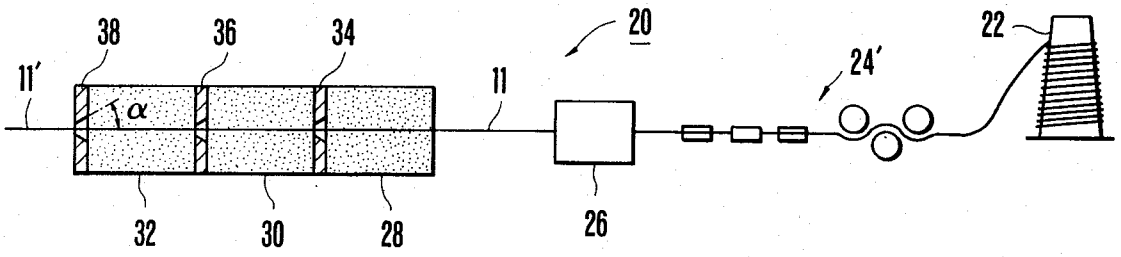
FIG. 1 is a schematic view showing the arrangement of a dry type continuous wire drawing machine exemplifying the present invention.

Since the present invention contains a number of preferred embodiments, the description will be made first upon the basic construction upstream of the drawing step and then upon a variety of modes of steps downstream of the drawing step.

Referring first to FIG. 1, a wire 11 to be drawn is held in such a state on a pay-off stand 22 of the dry type continuous wire drawing machine 20 according to the present invention that it is wound thereon in a coiled shape, and is then fed to a drawing line. This feed is performed by guiding the leading end of the wire 11, which has been sharpened at a preceding step. The wire 11 thus unwound from the pay-off stand 22 is guided to run via a leveler 24' of vertical and horizontal (i.e., V-H) construction through a shot blaster 26 acting as the descaling means. In this shot blaster 26, suitable shot particles and suitable shooting density are selected so that an oxide film and so on may be peeled from the surface of the wire 11.

Next, the wire 11 is guided through a lubricant surfacer bath 28, a reinforcing lubricant bath 30 and a pre-die lubricant bath 32 which are arranged in tandem in the recited order and are equipped at their respective exits with a lubricant surfacer applying die 34, a reinforcing lubricant applying die 36 and a wire drawing die 38. These baths 28 to 32 are respectively filled up with lime powder as the lubricating surfacer, the reinforcing lubricant such as sodium stearate, and the pre-die lubricant such as a mixture of calcium or sodium stearate and slaked lime.

The wire 11 passes through the lubricating surfacer bath 28 after it has been descaled, and is then guided through the lubricating surfacer applying die 34. During this passage, the wire 11 is coated with the lime powder. Then, since the bore diameter of the applying die 34 is predetermined at a value slightly larger than that of the target wire 11, both the lime powder, which has just been applied, and the surrounding lime powder are in turn squeezed between the bore wall and the surface of the wire 11, while this wire 11 is running through the bore of the applying die 34, so that the lime powder is pressure-applied to the surface of the wire 11. The lime powder functions as the surfacer of lubricants and to enhance the coating properties of both the reinforcing lubricant and the pre-die lubricant, which are to be subsequently applied. On the other hand, not only the slaked lime but also quick lime can be used as the lime powder. However, the slaked lime is preferred because hygroscopicity of the quick lime frequently raises a handling problem. The particle size of the lime powder is desired to be not smaller 2 microns.

Next, the wire 11 passes through the reinforcing lubricant bath 30 and the reinforcing lubricant applying die 36. During these passages, the reinforcing lubricant is pressure-applied as in the aforementioned case of the lime powder to the surface layer of the lime powder which has already been pressure-applied to the wire 11. Sodium stearate is used as the reinforcing lubricant. If the sodium stearate used has a particle size not larger than 2 microns, its coating density is reduced by the so-called "tunnel effect" resulting from the passage through the fluffy powder so that the lubricating effect becomes insufficient. It is, therefore, preferable that the particle size of the sodium stearate be at least 2 microns.

The application of the reinforcing lubricant should preferably be performed but can be omitted in the case of drawing a wire having a low strength.

The wire 11 is then guided into the pre-die lubricant bath 32. This bath 32 is filled with a mixed lubricant of calcium or sodium stearate and lime as the pre-die lubricant, which is to be pressure-applied to the surface layer of the wire 11. Next, the wire 11 is subjected to a drawing treatment at a predetermined working ratio by the action of the drawing die 38.

In the embodiment thus far described, the dies 34, 36 and 38 are exemplified by shaped bores but may be replaced by rollers.

Figure 2:
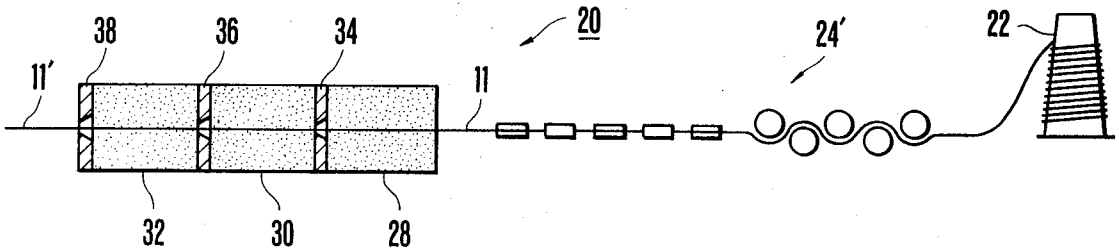
FIG. 2 is similar to FIG. 1 but shows another embodiment of the present invention.

In the foregoing embodiment, the shot blaster 26 is used as the mechanical descaler for mechanically effecting the descaling operation. As shown in FIG. 2, on the contrary, the shot blaster 26 may be replaced by a roll bender 24'. This roll bender 24' has a function to repeatedly bend and elongate the wire 11' so that the scale layer may be fissured and peeled off, and acts as the leveler. The drawing weight percentage of the roll bender 24' is suitably selected. Incidentally, it is quite natural that the roll bender 24' and the shot blaster 26 may be used together as the mechanical descaler.

Here, a major feature of the present invention will be described in detail, as compared with the prior art. The present invention is of the dry type and performs the continuous drawing treatment. As is different from the conventional batch-type treating system which is inefficient and uneconomical, the continuous wire drawing system according to the present invention can enjoy a line speed as high as about 120 m/min., for example, so that the treating efficiency can be remarkably improved.

The present invention adopts the dry type in the case of the continuous wire drawing treatment. There is known to the prior art the concept per se of disposing a dry type pre-die lubricant upstream of the drawing die so that the wire may be drawn after it has been coated with that lubricant. On the contrary, however, it is not before the present invention that the treatment with the lubricating surfacer and, if necessary, the treatment with the reinforcing lubricant are conducted in dry manners. According to the present invention, moreover, the lime powder is used as the lubricating surfacer. In the prior art, zinc phosphate, which is expensive but is excellent in lubricating properties, is used as the lubricating surfacer. The zinc phosphate cannot be applied to the present invention which resorts to the dry type treatment, because it is liquid. Therefore, the lime powder is used in place of the zinc phosphate. The drawn wire, which is prepared by the surfacing treatment with the lubricant of the lime powder and by the dry type lubrication, is not always superior, as for the conditions of the surface skin, to the drawn wire which is prepared by the wet type lubrication, which is conducted as a represenative of the prior art by a series of the pickling step → the surfacing step with zinc phosphate → the lubricating step with the mixture of lime and metallic soap.

The best advantage that can be attained thanks to the dry type system is the abilities of shortening the line length and reducing the cost for the facilities. For example, if it is intended to conduct the continuous treatment by the wet type system, the surfacing treatment with the lubricant and the lubricating treatment require a considerable reaction time for attaining a predetermined film thickness so that accordingly elongated facilities are indispensable. On the contrary, the dry type system can enjoy the aforementioned advantage because it requires at most the small-sized baths and the dies therefor. Moreover, the working circumstances are improved because no acid is used. Generally speaking, either the sodium stearate or the mixture of lime and calcium stearate is of powdered type and is dissolved according to the prior art before it is used for the wet type treatment. In the dry type system, on the contrary, the above-specified material may be used, as it is, so that it is remarkably excellent in handling.

On the other hand, the wire thus drawn has not only its intrinsic material flaw but also a handling flaw and/or a die flaw which has been caused by seizure or the like while passing through the drawing die. Of the material flaws, moreover, an internal one cannot be repaired. Still moreover, some surface flaws can be neither be repaired nor be suitable for the handling.

The drawn wire is treated along an identical line by the following modes according to the present invention.

Figure 3:
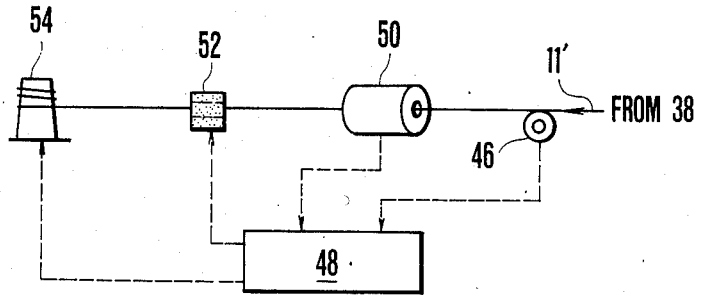
FIG. 3 is schematic view showing the construction of a line downstream of the wire drawing step and upstream of the drawn-wire take-up step.

FIG. 3 shows another embodiment of the present invention. A wire or distance speed meter 46 is provided to meter the running speed or distance of the aforementioned wire 11' which has been drawn. The speed or distance signal of the wire speed or distance meter 46 is fed to a control unit 48 so that it may be used for the speed or distance control through a later-described take-up roller. Downstream of the speed or distance meter 46, there is disposed a surface flaw detector 50 which is of an eddy current type or the like. The surface flaw state signal from that surface flaw detector 50 is also fed to the control unit 48 so that an automatic repairer 52 disposed subsequent to the surface flaw detector 50 may operate to eliminate the flawed surface portion in accordance with an instruction of the control unit 48. The wire thus repaired is wound up on the take-up roller 54. Next, the wire 11' thus wound is transferred to a subsequent step for a secondary drawing operation.

Here, the speed or distance meter 46 meters the running speed of the wire 11' having been primarily drawn. The position in which the speed or distance meter 46 is to be disposed may be basically be located, as seen from FIG. 3, downstream of the drawing die 38 (which should be referred to FIGS. 1 and 2) or the surface flaw detector 50. Alternatively, the running speed or distance of the wire 11' may be metered in terms of the number of revolutions per minute of the take-up roller 54. The wire running speed may be arbitrarily selected but is set at 60 to 80 m/min. for a wire diameter of 10 to 15 mm, at 40 to 60 m/min. for a wire diameter of 15 to 20 mm, or at 10 to 15 m/min. for a wire diameter of 20 to 25 mm, for example.

The surface flaw detector 50 may be exemplified by an ultrasonic one but is preferably embodied by an eddy current one in view of the points of its detecting power and stability. The flaw detector 50 not only locates the flaw, namely, detects the circumferentially angular position and the longitudinal position of the flaw but also meters the depth of the flaw or the like. In this instance, the longitudinal position of the flaw is judged by the control unit 48 on the basis of the signal coming from the speed meter 46.

The surface flaw thus detected is automatically repaired by the automatic repairer 52 in response to an instruction from the control unit 48. In the automatic repairer 52, a surface flaw repairing tool such as a honing stone, a belt grinder or a cutting, peeling or shaving tool, or preferably the internal honing stone 52, as shown, is made to revolve around the drawn wire 11' so that it may be promptly brought into abutment against the surface of the drawn wire 11' as soon as the flawed surface portion reaches the position of the internal honing stone 52. In case this repairing tool is circumferentially displaced from the position of the surface flaw, on the other hand, the repairing operation is started after the repairing tool is turned into position. If necessary, a plurality of repairing tools may be disposed circumferentially of the drawn wire 11'. Moreover, the repair range is made slightly larger than the length, depth and width of the surface flaw under consideration. From the standpoint of the yield, still moreover, the repair should be conducted not allover the length and circumference of the surface flaw but only that flawed surface portion in the circumferential direction.

When in operation, let the case be considered in which the repairer 52 cannot follow the running speed of the wire 11'. If a surface flaw is detected, the take-up roller 54 is decelerated or halted through the speed control circuit of a winding motor accompanying the take-up roller 54 in response to an instruction of the control unit 48, at the instant when that flawed portion reaches the repairer 52, so that the wire sending operation may be decelerated or interrupted to facilitate the repairing operation. After this repair, the wire running speed is returned to its original value.

Figure 4:
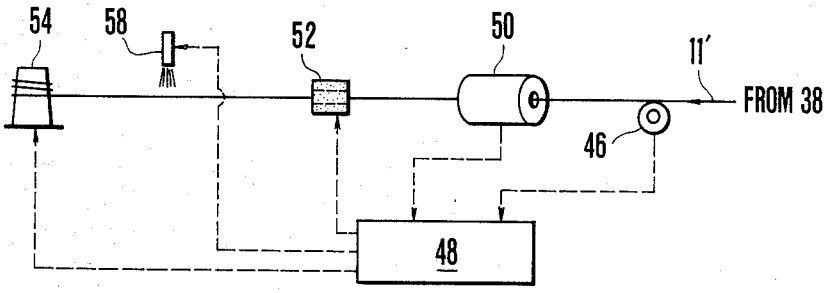
FIG. 4 is similar to FIG. 3 but shows another embodiment of the present invention.

FIG. 4 shows another embodiment of the present invention. In case the flawed surface portion detected by the flaw detector 50 has a depth exceeding about 0.2 mm or a number of flaws existing in an identical portion so that it is not within the capacity of the automatic repairer 52, it is either repaired as deeply as possible or left unrepaired and marked by an unrepaired flaw marker 58 in response to an instruction of the control unit 48. The flaw or flaws left unrepaired are repaired off-line after the wire 11' has been wound up.

In this instance, the unrepaired flaw marker 58 is desirably made to revolve around the drawn wire 11' so that it can cover the whole circumference. In an alternative, a plurality of unit markers are disposed in the circumferential direction so that the flaw or flaws may be marked by the unit marker or markers arranged at the corresponding sections. The marking operation can be conducted such that the flaws are discriminated either in different colors or at the rates of injection in accordance with the depths or kinds thereof.

Figure 5:
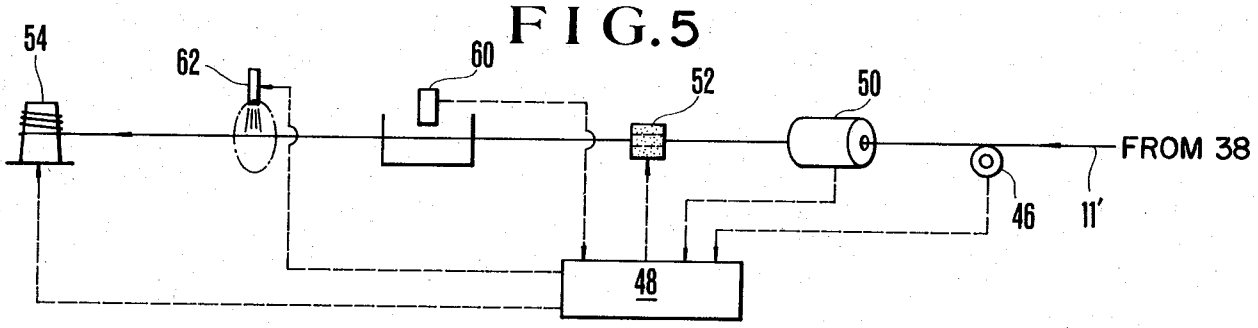
FIG. 5, 6, 7, and 8 are also similar to FIG. 3 but show other embodiments of the present invention.

Turning to FIG. 5 showing a further embodiment of the present invention, an ultrasonic flaw detector 60 of submerged type is disposed downstream of the automatic repairer 52 thereby to detect an internal defect, which cannot be repaired, so that the internally defected portion may be marked by an internal defect marker 62 disposed downstream of the ultrasonic flaw detector 60, which has a construction similar to that of the unrepaired flaw marker 58 and which is made operative in response to an instruction of the control unit 48. The internally defected portion thus detected is scrapped or not used after the drawn wire has been wound up.

Figure 6:
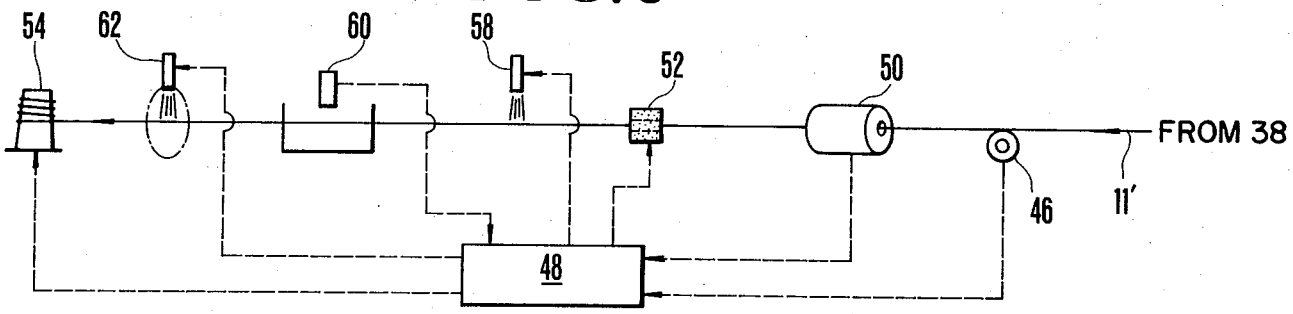

FIG. 6 shows a further embodiment of the present invention, which is different from the line of FIG. 5 in that the unrepaired flaw marker 58 is interposed between the automatic repairer 52 and the ultrasonic flaw detector 60.

Figure 7:
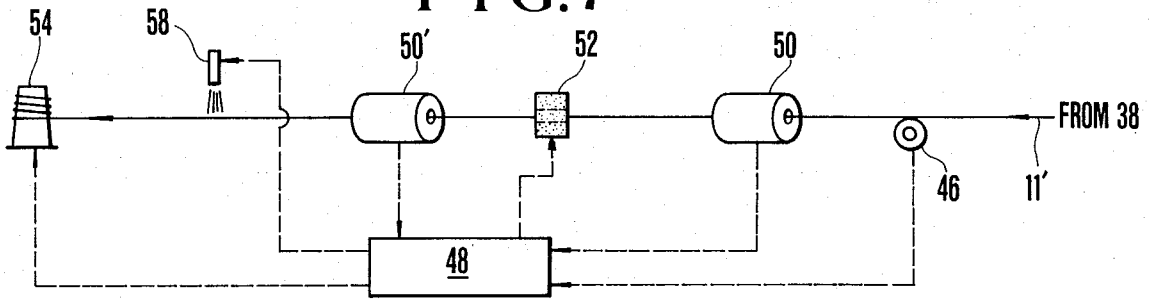

FIG. 7 shows a further embodiment of the present invention, in which a second surface flaw detector 50' is disposed downstream of the automatic repairer 52 so that it may detect whether or not there is a portion left unrepaired by the automatic repairer 52. The portion, if left unrepaired, is indicated by the unrepaired flaw marker 58.

Figure 8:
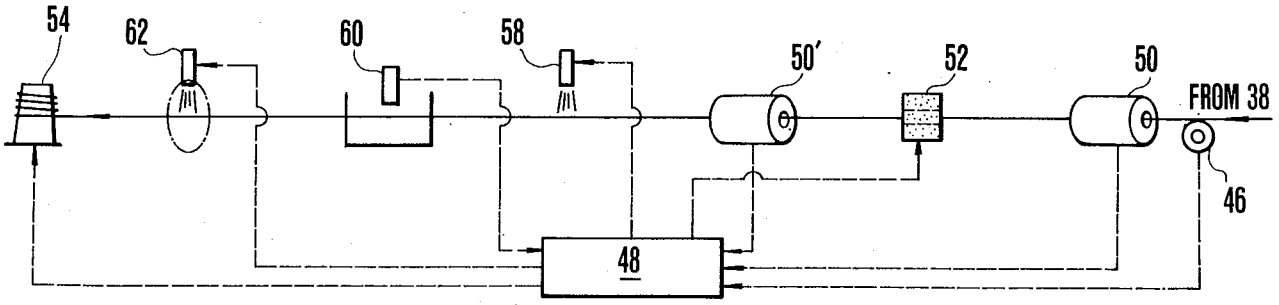

FIG. 8 shows a further embodiment of the present invention, in which the ultrasonic flaw detector 60 and the internal defect marker 62 are added, downstream of the unrepaired flaw marker 58, to the line having a construction similar to that of the embodiment of FIG. 7.

The embodiment of FIG. 8 is the most preferable because it can cover all the operating steps inclusive, but the embodiment of FIG. 5 is the most practical if the cost for the facilities are taken into account.

In the embodiments thus far described, it is desired that the respective devices or components of the line be arranged in the shown order. However, it is possible, for example, to detect the surface flaw after the internal defect has been detected in advance or to change the position of the marker or markers. It is also possible to simultaneously detect the internal defect and the surface flaw. This can be exemplified by the process resorting to the discrimination of the waveforms of an ultrasonic flaw detecting signal.

Thus, according to the present invention, since the flaw detection and automatic repair of the drawn wire are conduted in-line, it is possible not only to achieve reduction in the number of the repairing steps, reduce the space for installation and eliminate the transporting works but also to treat the drawn wire at a high speed so that a flawless wire can be shipped with remarkably effective warranty.

The present invention will be described in more detail in connection with the Examples 1 to 3.

EXAMPLE 1

The drawing operation was conducted by using the wire drawing facilities having a construction similar to those of FIGS. 1 and 5. The wire used was an as-rolled material made of 0.4% C. carbon steel and having a diameter of 14.0 mm. This wire was drawn under the following conditions:

(a) Descaling condition

Shot blast was conducted by shooting steel balls having a mean diameter of 0.3 mm with a shooting density of about 300 kg/m$^2$.

(b) Lubricating Condition

The surfacing operation with a lubricant was conducted by the use of lime powder having a mean particle diameter of 15 microns. The reinforcing lubrication was conducted by the use of sodium stearate having a mean particle diameter of 12.5 microns. The pre-die lubrication was conducted by the use of a mixture of lime and calcium stearate.

(c) Drawing Condition

A drawn wire having a diameter of 11.6 mm was prepared at a running speed of 41 m/min. and in a reduction of area of 26.2% by using a drawing die having a die angle of 2=20 degrees and a bearing portion of a length of 0.5 d (wherein letter d designates the diameter of the die).

(d) Flaw Detecting Condition

The surface flaw was detected at a phase angle of 130 degrees and with a frequency of 64 KHz by the use of a rotary probe type eddy current flaw detector. On the other hand, the internal defect was detected with a frequency of 20 MHz by the use of a submerged type ultrasonic flaw detector.

(e) Automatic Repairing Condition

The automatic repair was conducted by dividing the circumference of the wire into thirty six sections and by repairing only the local section, in which the surface flaw is detected, with the inner wall of a rotary honing stone having a cylindrical shape.

The comparison between the drawing system of the present invention and a reference of the prior art, in which only the pre-die lubrication was conducted, is presented in Table 1. In this Table, the die life indicates the drawing weight of the wire until the drawing die seizes, and freedom of the seizure means excellent lubrication of the wire.

TABLE 1

| | Lubricating Condition | Die Life | Flaw Detecting Power (1) | Flaw Detecting Power (2) |
|---|---|---|---|---|
| Prior Art | only C | 1,000 — 2.000 kg | | |
| Invention 1 | A + C | 5,000 — 6,000 kg | 5/100 mm | 0.2 mm |
| Invention 2 | A + B + C | 10,000 — 12,000 kg | 5/100 mm | 0.2 mm |

wherein:
(1) indicates lower limit of depth of surface flaw detectable; and
(2) indicates internal defect detectable.
wherein
A: Surfacing Treatment for Lubrication (with lime)
B: Lubricating Treatment for Reinforcement (with sodium trearate)
C: Pre-Die Lubricating Treatment Incidentally, the results of investigating the coating density of sodium stearate for different mean particle diameters are presented in Table 2. The particles of the sodium stearate having a mean diameter less than 2 microns were adversely affected by the so-called "tunnel effect" so that they could not coat the wire at a satisfactory density thereby to fail to meet the practical purpose.

TABLE 2

| Particle Diameter | Coating Density |
|---|---|
| 2 to 3 microns | 0.8 g/m$^2$ |
| 5 to 7 microns | 4.1 g/m$^2$ |

In view of the foregoing Table 1, it is concluded that a drawn wire of high quality could be produced according to the present invention

EXAMPLE 2

The drawing operation was conducted by the use of the line having a construction similar to that of FIGS. 2 and 5. The bending roll unit used was constructed such that two series of five rolls having a diameter of 90 mm were arranged vertically and horizontally. The drawing weight of the wire by that roll bender was 10%. On the other hand, the roller die was used. The results are tabulated in Table 3.

TABLE 3

| | Lubricating Condition | Die Life | | Flaw Detecting Power | |
|---|---|---|---|---|---|
| | | Bored Die | Roller Die | (1) | (2) |
| Prior Art | only C | 1,500 — 3,000 kg | 100,000 — 150,000 kg | — | — |
| Invention 1 | A + C | 7,500 — 9,000 kg | 120,000 — 170,000 kg | 5/100 mm | 0.2 mm |
| Invention 2 | A + B + C | 15,000 — 30,000 kg | 150,000 — 200,000 kg | 5/100 mm | 0.2 mm |

wherein: A, B, C, (1) and (2) indicate those of the Table 1.

From the above results, it is found that the die life was improved as compared with that of the shot blast system of the Example 1. This improvement was acquired by the back tension which had been generated by the bending operation. By this operation of the bending roll, more specifically, a tension in the direction opposite to the running direction was applied to the wire 11. As a result, the surface pressure to be exerted upon the die was so reduced that the die life was improved.

EXAMPLE 3

The line construction was similar to that of the Example 2, but the drawing weight of the wire by the roll bender was 32%, and the drawing step was conducted simultaneously with the descaling step. In operation, the material wire having a diameter of 14 mm was drawn to a diameter of 12.2 mm in a reduction of area of 24%. As a result, another drawing step using a bored die (which was identical to that of the Example 1) reduced the area of the wire by about 10%, that is to say, the wire having a diameter of 11.6 mm. The results are presented in Table 4 and reveal that the die life was remarkably improved thanks to further increase in the back tension.

TABLE 4

| | Lubricating Condition | Die Life | Flaw Detecting Power | |
|---|---|---|---|---|
| | | | (1) | (2) |
| Prior Art | only C | 10,000 — 20,000 kg | — | — |
| Invention 1 | A + C | 50,000 — 60,000 kg | 5/100 mm | 0.2 mm |
| Invention 2 | A + B + C | 100,000 — 120,000 kg | 5/100 mm | 0.2 mm |

wherein:
(1) indicates lower limit of depth of surface flaw detectable; and
(2) indicates internal defect detectable.
wherein: A, B and C indicate those of the Table 1.

What is claimed is:

1. A dry type continuous wire drawing machine comprising:

a pay-off stand for supplying a wire to be drawn therefrom;

mechanical descaling means for removing scale from said wire;

lubricating surfacer treating means having an applying die for pressure-applying a powdered lubricating surfacer to the surface of said wire;

pre-die dry type lubrication treating means;

a drawing die for drawing the wire which has been subjected to the lubrication;

a surface flaw detector for detecting surface flaws on the drawn wire;

automatic repairing means for removing the flawed surface portion of said drawn wire;

a control unit which is responsive to a signal from said surface flaw detector for sending a repair signal to said automatic repairing means; and take-up means for taking up the repaired wire, wherein the components of said machine except said control unit are consecutively arranged in series.

2. The dry type continuous wire drawing machine according to claim 1 further comprising:

an unrepaired flaw marker for marking surface flaws detected which cannot be automatically repaired in response to an instruction from said control unit.

3. The dry type continous wire drawing machine according to claim 1 further comprising:

ultrasonic flaw detecting means for detecing an internal flaw of the repaired wire and sending a signal to the control unit; and an internal defect marker for marking the surface of said wire which corresponds to the internal flaw in response to an instruction from the control unit.

4. The dry type continuous wire drawing machine according to claim 1 further comprising:

reinforcing-lubricant treating means having a pressure-applying die for pressure-applying a reinforcing lubricant to said lubricating surfacer;

locating means for locating the detected surface flaws; and speed control means connected to the take-up means wherein when the automatic repairing means operates to remove a flawed surface portion of the wire, the speed control means decelerates the take-up means to permit sufficient time for removing the flawed surface portion.

5. A dry type continuous wire drawing machine comprising:

a pay-off stand for supplying a wire to be drawn therefrom;

mechanical descaling means for removing scale from said wire;

lubricating surfacer treating means having an applying die for pressure-applying a powdered lubricating surfacer to the surface of said wire;

pre-die dry type lubrication treating means;

a drawing die for drawing the wire which has been subjected to the lubrication;

a first surface flaw detector for detecting surface flaws on the drawn wire;

automatic repairing means for removing surface flaws on said drawn wire;

a control unit which is responsive to a signal from said first surface flaw detector for sending a repair signal to said automatic repairing means;

a second surface flaw detector for detecting surface flaws left in the repaired wire and sending a signal to the control unit;

an unrepaired flaw marker for marking the surface flaws left in the wire in response to an instruction from the control unit upon receipt of the signal from the second surface flaw detector; and take-up means for taking up the repaired wire, wherein the components of said machine except said control unit are consecutively arranged in series.

6. The dry type continuous wire drawing machine according to claim 5 further comprising:

ultrasonic flaw detecting means for detecting an internal defect of the repaired wire and sending a signal to the control unit; and an internal defect marker for marking the surface of said wire which corresponds to the internal defect in response to an instruction from said control unit.

* * * * *